US006124591A

United States Patent [19]

Schwartz et al.

[11] Patent Number: 6,124,591

[45] Date of Patent: Sep. 26, 2000

[54] METHOD OF ION FRAGMENTATION IN A QUADRUPOLE ION TRAP

[75] Inventors: Jae C. Schwartz; Dennis M. Taylor, both of San Jose, Calif.

[73] Assignee: Finnigan Corporation, San Jose, Calif.

[21] Appl. No.: 09/416,128

[22] Filed: Oct. 12, 1999

Related U.S. Application Data

[60] Provisional application No. 60/104,458, Oct. 16, 1998.

[51] Int. Cl.[7] ..... H01J 49/42

[52] U.S. Cl. ..... 250/282; 250/292

[58] Field of Search ..... 250/282, 292

[56] References Cited

U.S. PATENT DOCUMENTS 5,298,746 3/1994 Franzen et al. ..... 250/292

5,404,011 4/1995 Wells et al. ..... 250/282

OTHER PUBLICATIONS

Haller, Ivan et al., "Collision Induced Decomposition of Peptides. Choice of Collision Parameters", *J Am Soc Mass Spectrom*, vol. 7, 677–681 (1996).

*Primary Examiner*—Jack Berman

*Attorney, Agent, or Firm*—Flehr Hohbach Test Albritton & Herbert LLP

[57] ABSTRACT

There is described a method of generating product ions in a quadrupole ion trap in which the amplitude of the applied excitation voltage for an ion of a given mass-to-charge ratio (m/z) is linearly related to its mass-to-charge ratio (m/z).

27 Claims, 10 Drawing Sheets

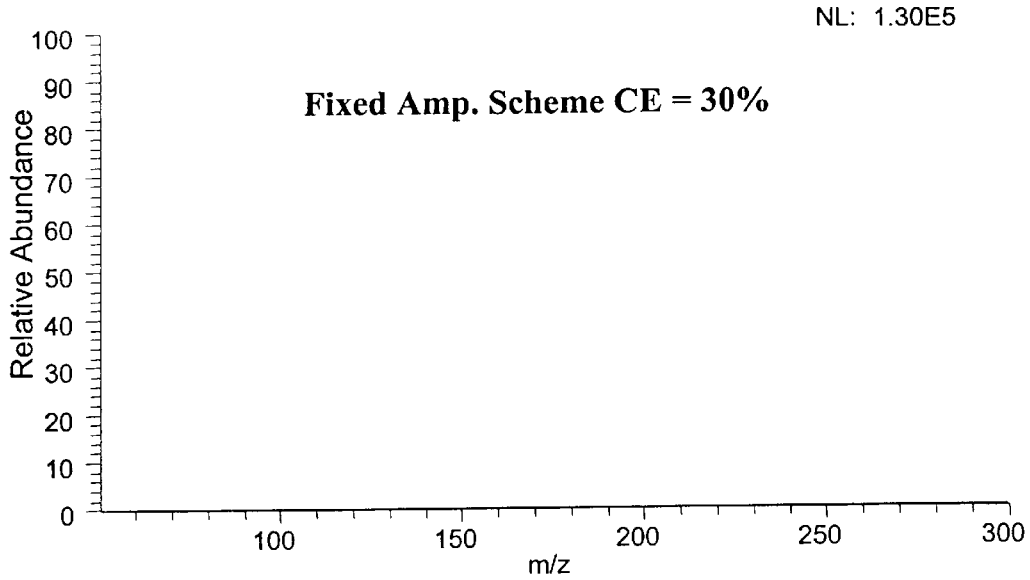
Figure 10A1
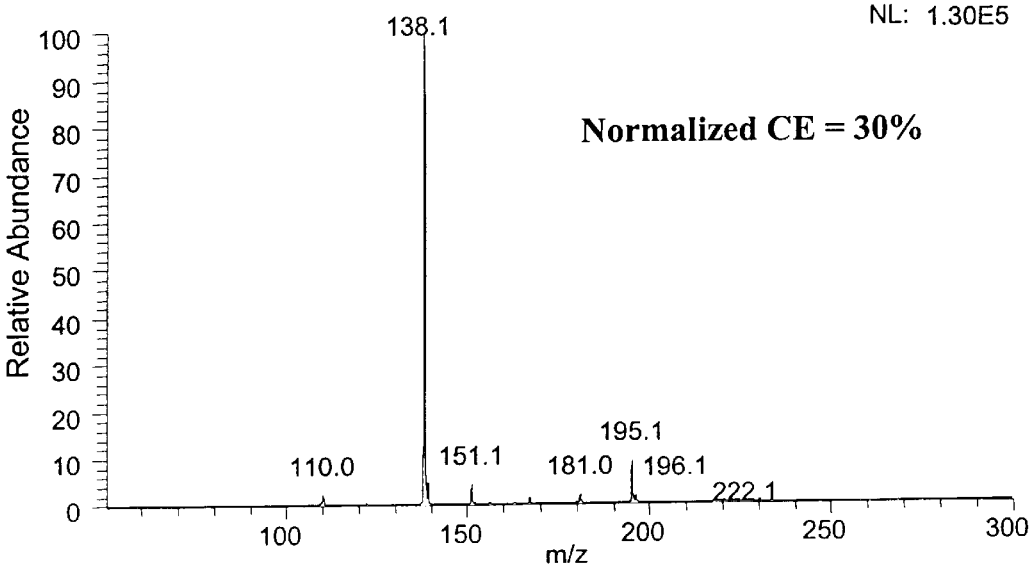
Figure 10A2

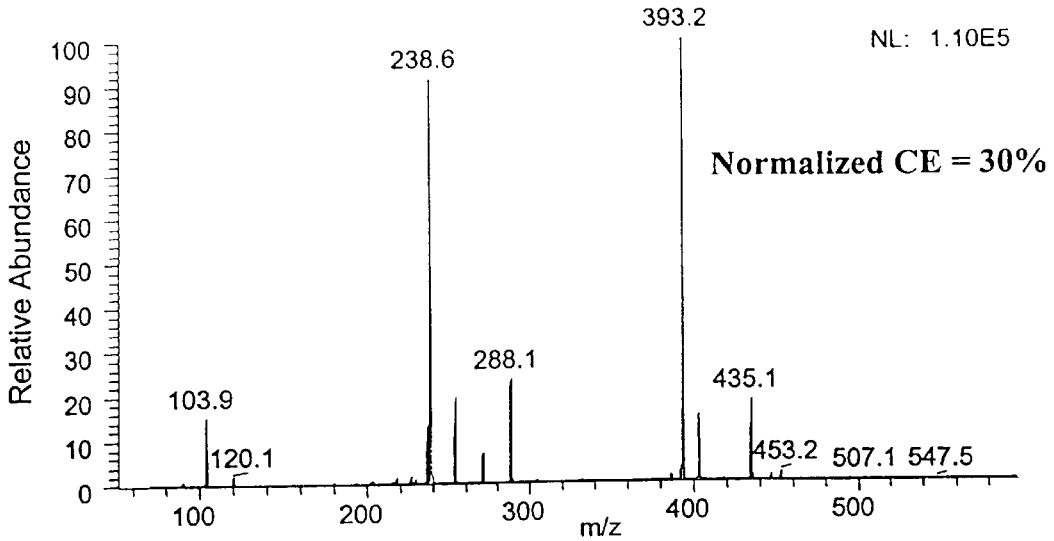
Figure 10B1
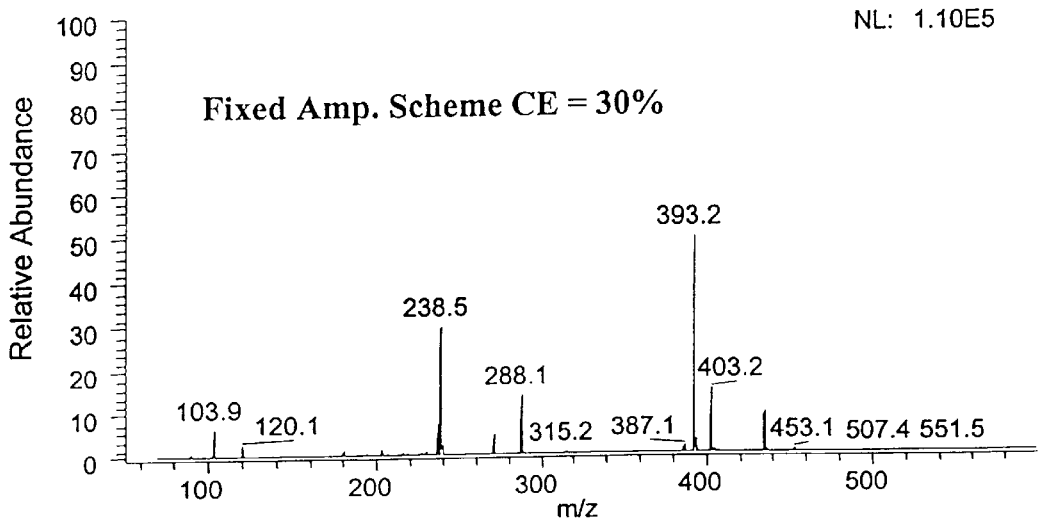
Figure 10B2

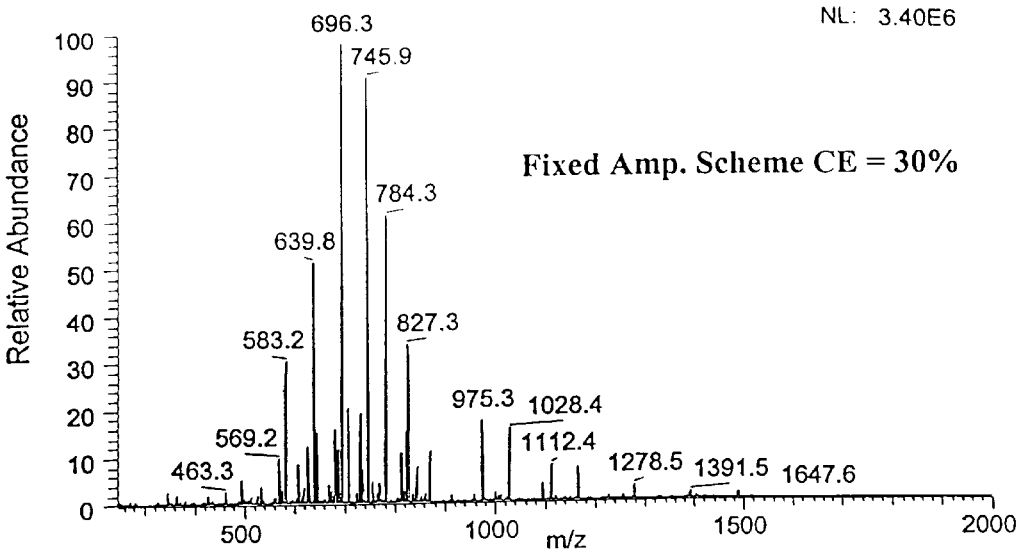
Figure 10C1
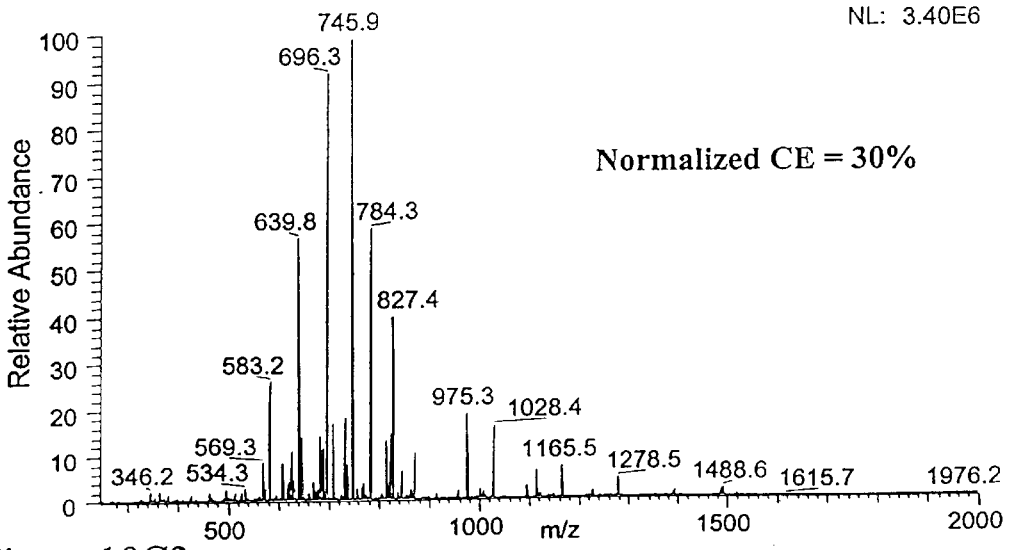
Figure 10C2

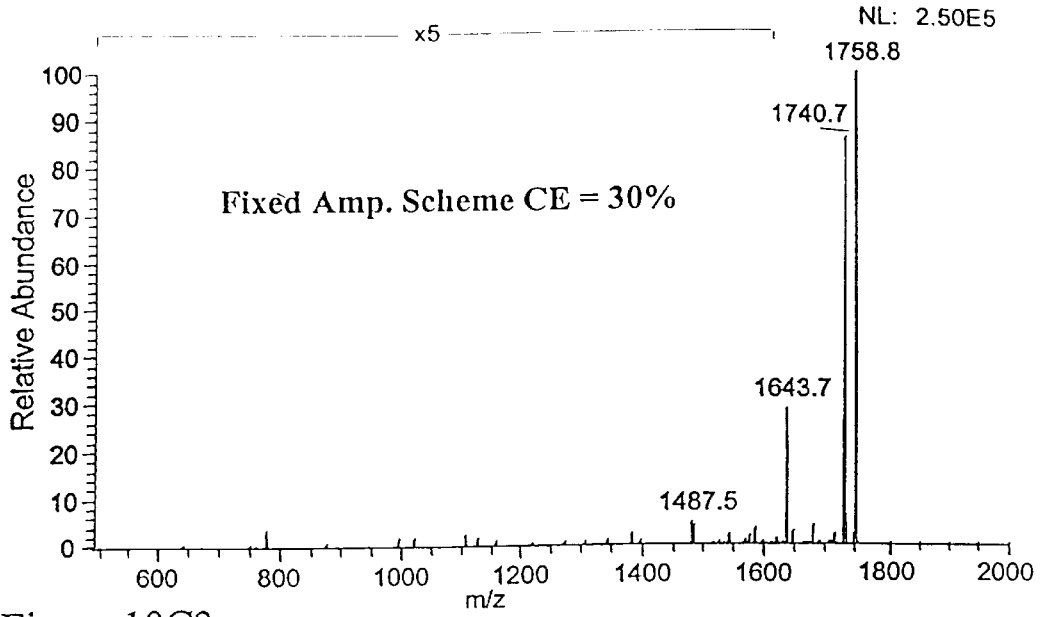
Figure 10C3
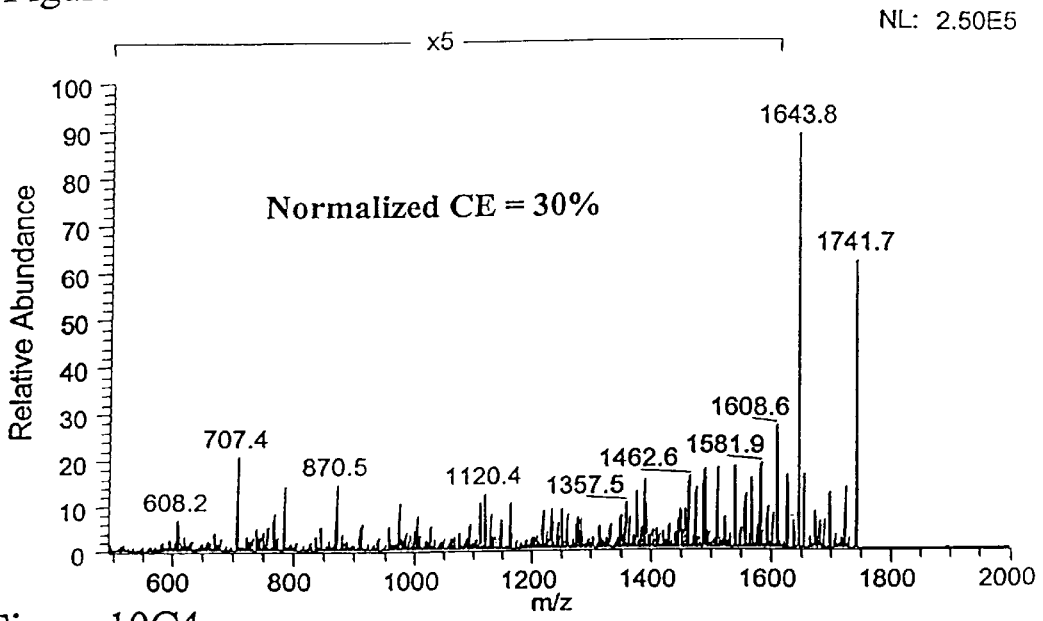
Figure 10C4

METHOD OF ION FRAGMENTATION IN A QUADRUPOLE ION TRAP

PRIORITY APPLICATION

This application claims priority to U.S. Provisional Application Ser. No. 60/104,458 filed Oct. 16, 1998.

BRIEF DESCRIPTION OF THE INVENTION

This invention relates generally to a method of ion fragmentation in a quadrupole ion trap and more particularly to a method in which the selected excitation energy for an ion of given mass-to-charge ratio is substantially linearly related to its mass-to-charge ratio (m/z).

BACKGROUND OF THE INVENTION

In U.S. Pat. No. 4,540,884 there is described a method of mass analyzing a sample by the use of a quadrupole ion trap. Basically, a wide range of ions of interest are created in or stored in an ion trap during an ionization step. In one method, the r.f. voltage applied to the ring electrode of the quadrupole ion trap is then increased and trapped ions of consecutively increasing specific mass-to-charge ratio (m/z) exit the ion trap. These ions are detected to provide an output signal indicative of the masses of stored ions.

In U.S. Pat. No. 5,420,425, there is described an ion trap mass spectrometer for analyzing ions, and more particularly a substantially quadrupole ion trap mass spectrometer with an enlarged ion occupied volume. Described therein are electrode geometries that enlarge the ion occupied volume. Improved ion sensitivities, detection limits and dynamic ranges are realized for the same charge density in these devices, because the increased ion occupied volume allows for the storage of a greater number of ions. The ion trap geometries described apply to all modes of operation of substantially quadrupole ion traps, such as the mass selective instability mode, resonance excitation/ejection, and $MS^n$.

In U.S. Pat. No. Re 34,000 there is disclosed a method of performing MS/MS in a quadrupole ion trap. Ions stored within the quadrupole ion trap are excited by applying an excitation voltage of predetermined frequency for a predetermined time across the end caps of the ion trap. Ions that follow orbital trajectories at a frequency resonant or near resonant with the excitation frequency gain kinetic energy as they absorb AC power. The ions involved in this excitation undergo dissociation by ion molecule or ion/ion collisions within the trap (collision-induced dissociation). The dissociated ions are then caused to leave the ion trap by changing the trapping voltages as described above to obtain a mass spectrum of the dissociated ions.

The resonance excitation (RE) method has been found to be very effective in fragmenting ions in a quadrupole ion trap and is very efficient in terms of converting parent ions into product ions without much loss of total charge. However, in order to obtain optimal fragmentation efficiency for a particular ion, the amplitude of the applied resonance excitation voltage must often be tuned for each ion of interest. It has been argued that fragile ions, for example a 2+ or 3+ multiply charged ion should in general be more easily fragmented than the 1+ ion of the same mass, and therefore would require less resonance excitation voltage amplitude. Charge state and other structural characteristics were often thought to be the primary cause of the variations in required excitation voltage amplitude. The fact that different ions require different excitation voltage amplitudes precludes the ability of doing automated experiments where the choice of parent ion is not predetermined but made in real time in a chromatographic or other fast time scale. Under these circumstances, tuning of the voltage amplitude is not practical, since in general it is a time-consuming process.

In addition to this limitation, the particular setting of resonance excitation voltage amplitude required to fragment a given ion optimally can differ from one instrument to another. These differences depend on variations in instrumental parameters such as power supplies and other electronics, as well as variation in helium and background gas pressures. Consequently, the same excitation voltage amplitude used on multiple instruments may not give identical results.

Both of these limitations can be significantly improved upon by using the present invention which attempts to normalize out the primary variations in optimal resonance excitation voltage amplitude for differing ions, and also the variations due to instrumental differences.

OBJECTS AND SUMMARY OF THE INVENTION

It is an object of the present invention to provide a method of collisionally inducing dissociation in an ion trap with improved performance.

It is another object of the present invention to provide a method of operating an ion trap for collisionally induced dissociation using normalized excitation voltage amplitude or collision energy.

The present invention relates to a method of collisionally inducing ion fragmentation in an ion trap which includes the steps of applying an excitation voltage to the ion trap whose amplitude is substantially linearly related to the mass-to-charge ratio of the ion to be fragmented for a particular instrument, and to calibrating the substantially linear relationship on a per instrument basis with a simple and fast calibration process.

BRIEF DESCRIPTION OF THE DRAWINGS

The foregoing and other objects of the invention will be more clearly understood from the following description when read in conjunction with the accompanying drawings in which:

FIGS. 10A1–10C4 show example spectra from the set of data of FIG. 9 indicating the effectiveness of using normalized excitation voltage amplitude in comparison to the prior use of one setting of the relative excitation voltage (collision energy) for four ions of different m/z.

DESCRIPTION OF PREFERRED EMBODIMENT

Figure 1:
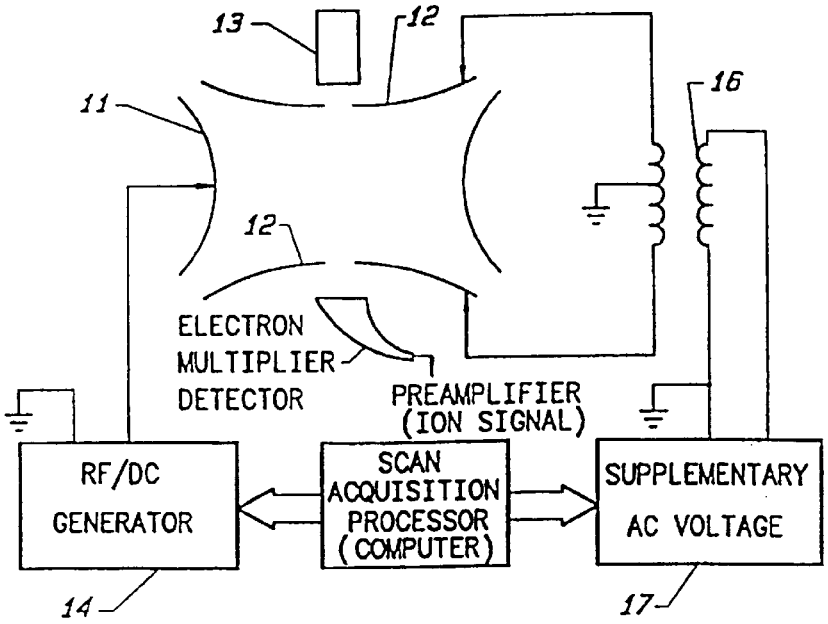
FIG. 1 is a schematic diagram of an ion trap mass spectrometer useful in carrying out the invention.
Figure 2A:
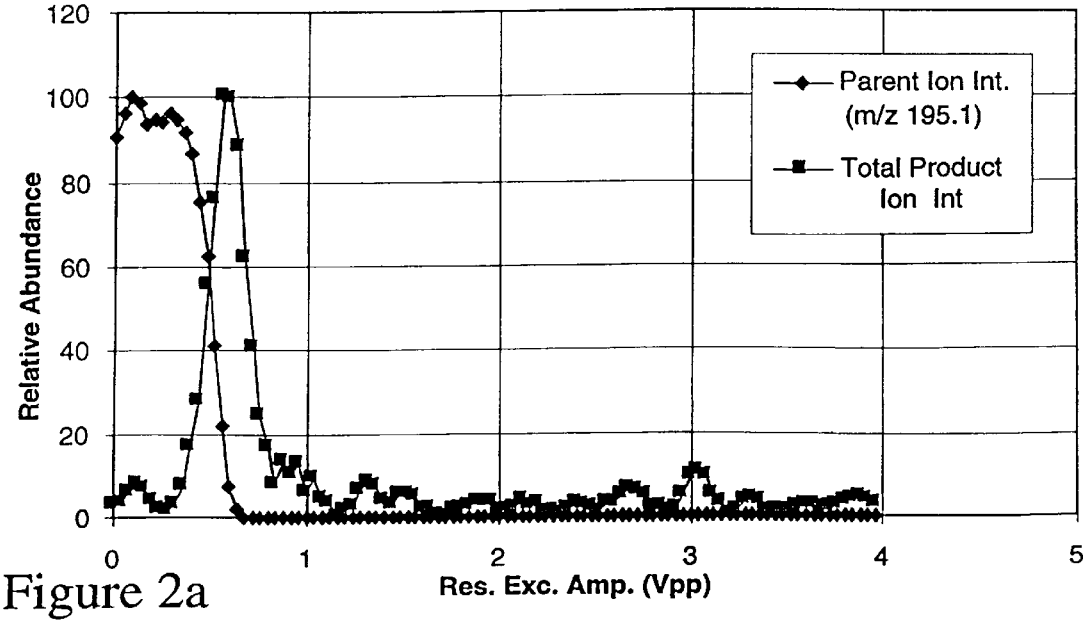
FIGS. 2*a*–2*d* are plots of the parent ion relative intensity and product ion relative intensity as a function of the resonance excitation amplitude for four representative ions from low m/z (2*a*) to high m/z (2*d*).
Figure 2B:
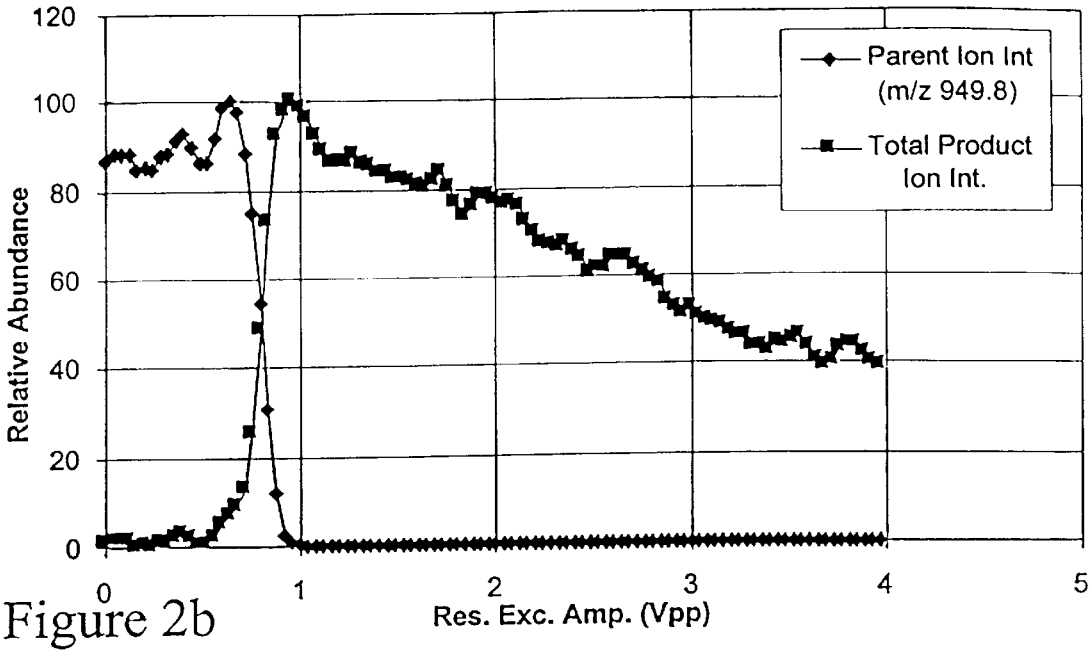
Figure 2C:
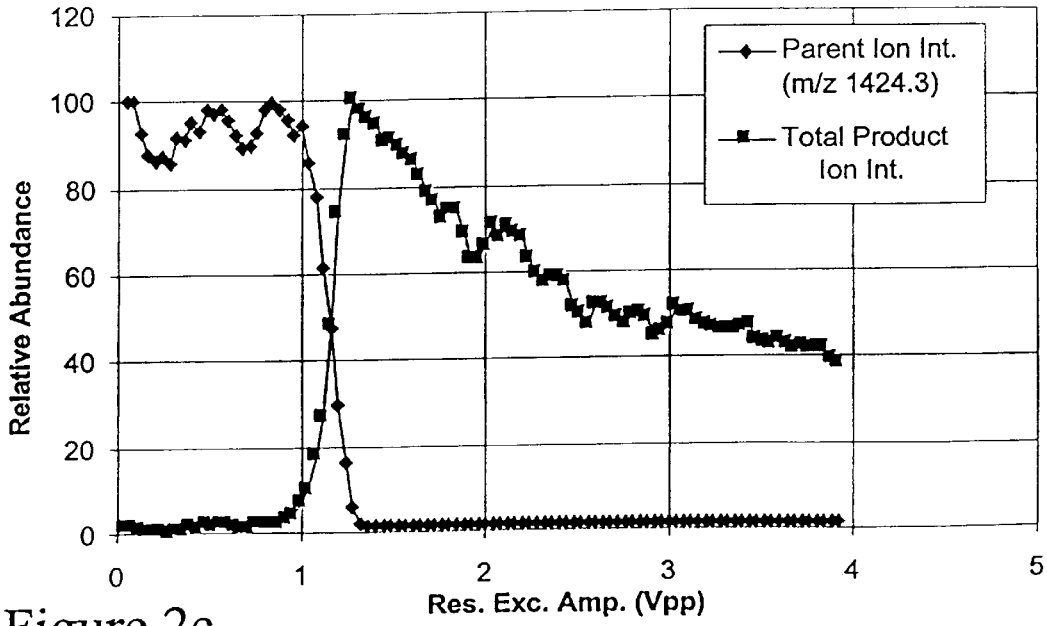
Figure 2D:
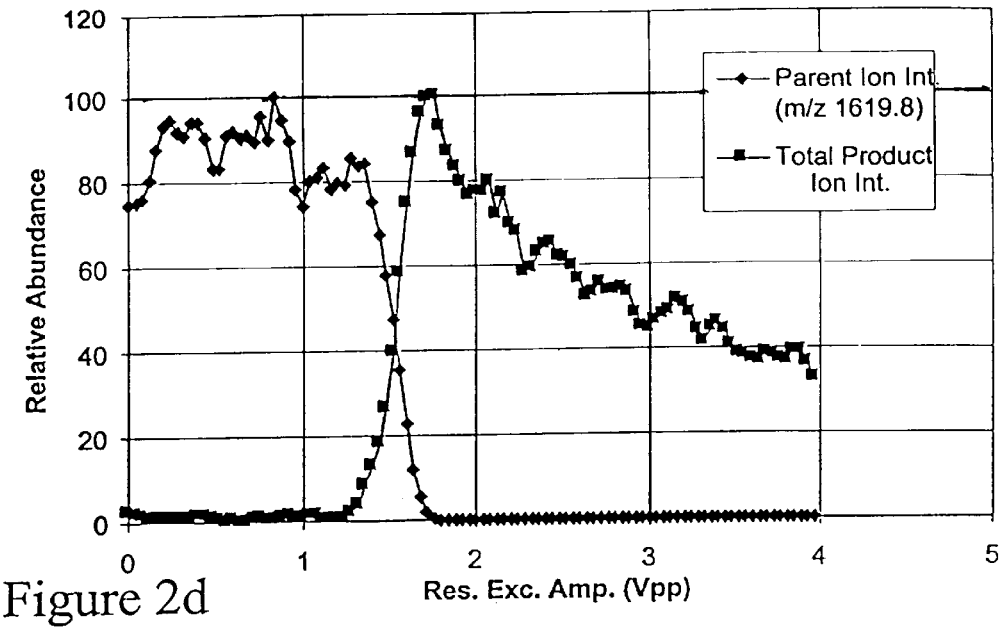

Referring to FIG. 1, there is schematically illustrated a quadrupole ion trap which includes a ring electrode 11, spaced end caps 12, and an electron gun 13 for ionizing samples introduced into the trap as, for example, from a gas chromatograph or other sample source (not shown). Alternatively, the electron gun 13 may be an external ionizer (ionization source) that injects externally formed sample ions into said trap. In the following description, both methods are referred to as introducing ions into the ion trap. Suitable voltages are applied to the ring electrode 11 via the amplifier and r.f./DC generator 14. The trap preferably contains a collision or damping gas as described in U.S. Pat. Nos. 4,540,884 and RE34000. Excitation or ejection voltages are applied across the end caps 12 from the supplementary AC voltage generator 17 to the transformer 16 whose secondary is connected across the end caps. A scan acquisition processor (computer) controls the application and amplitude of the voltages applied to the ion trap electrodes. Although a particular ion trap has been described, the present invention is applicable to other types of quadrupole ion traps, such as shown in U.S. Pat. No. 5,420,425.

Before the scanning process, ions are first trapped in the ion trap by applying the appropriate trapping voltages to the ion trap elements at the correct time. Isolation of the parent ions of interest is performed using an appropriate ion isolation technique, in this particular case a multi-frequency resonance ejection waveform such as discussed in U.S. Pat. No. 5,324,939, incorporated herein by reference. After isolation, collision induced dissociation or fragmentation is performed in the ion trap using an r.f. excitation voltage applied across the end caps of the ion trap for a predetermined time, in the present example, 30 msec. After the excitation period, all ions in the trap are ejected by changing the trapping voltage, as described in U.S. Pat. Nos. 4,540,884 and RE34,000, and detected to produce a mass spectrum.

Figure 3:
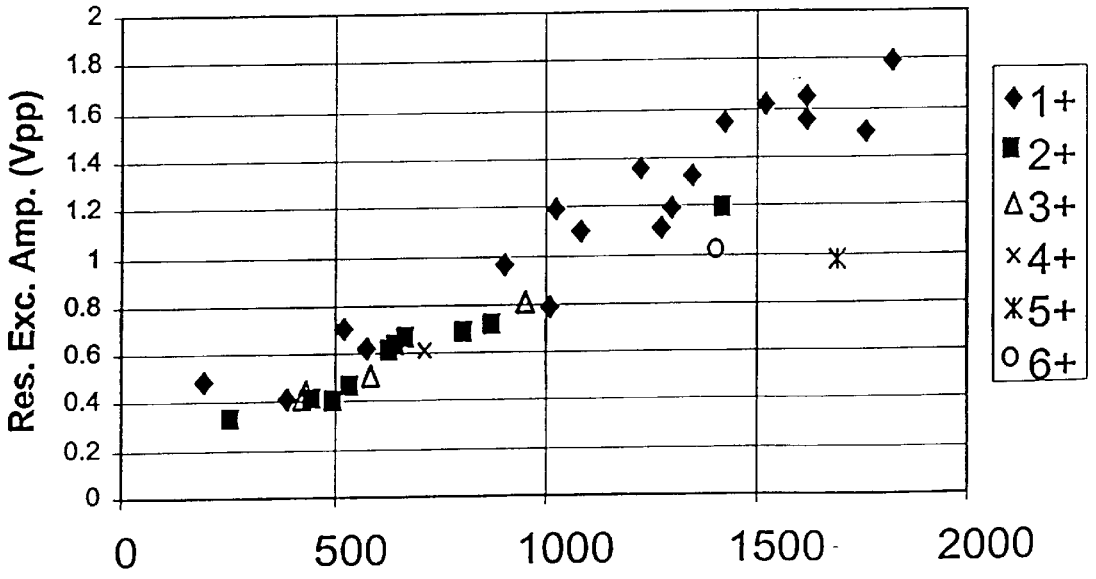
FIG. 3 is a plot of experimental data showing the linear relationship of the resonance excitation amplitude required to form 50% of the maximum allowable total product ion intensity as a function of m/z for various ions including those with differing charge states.

All the ions listed in Table 1 were studied by increasing the resonance excitation voltage amplitudes from 0 to 4 Vpp in steps of 0.04 volts. Four examples of the relationship between the reduction in parent ion intensity and formation of product ions as a function of the resonance excitation voltage are demonstrated in FIGS. 2*a*–2*d* for ions of increasing m/z and for various charge states. More specifically, the breakdown curves for Caffeine $(M+H)^+$, m/z=195.1; Melittin $(M+3H)^{3+}$, m/z=949.8; Melittin $(M+2H)^{2+}$, m/z=1424.3 and Bombesin $(M+H)^+$, m/z=1619.8, are shown in FIGS. 2*a*–2*d* respectively. FIG. 3 shows the resonance excitation amplitude required to produce 50% of the total product ion intensity for all the ions from Table 1 including those with differing charge states. This data indicates that the optimum resonance excitation amplitude is primarily controlled by a substantially linear relationship to the mass-to-charge ratio (m/z) of the ions despite a variety of structures, charge states and stability. Although these factors can affect the excitation amplitude required, their contribution is a secondary one and only predominates after compensation for the primary effect of m/z. It is well known that the resonance excitation amplitude required to give ions the same average velocity at a given excitation frequency is linearly related to m/z, but these data suggest that this dependence also dominates the fragmentation process despite significant structural differences and kinetic energies which are traditionally thought to control fragmentation.

Figure 4:
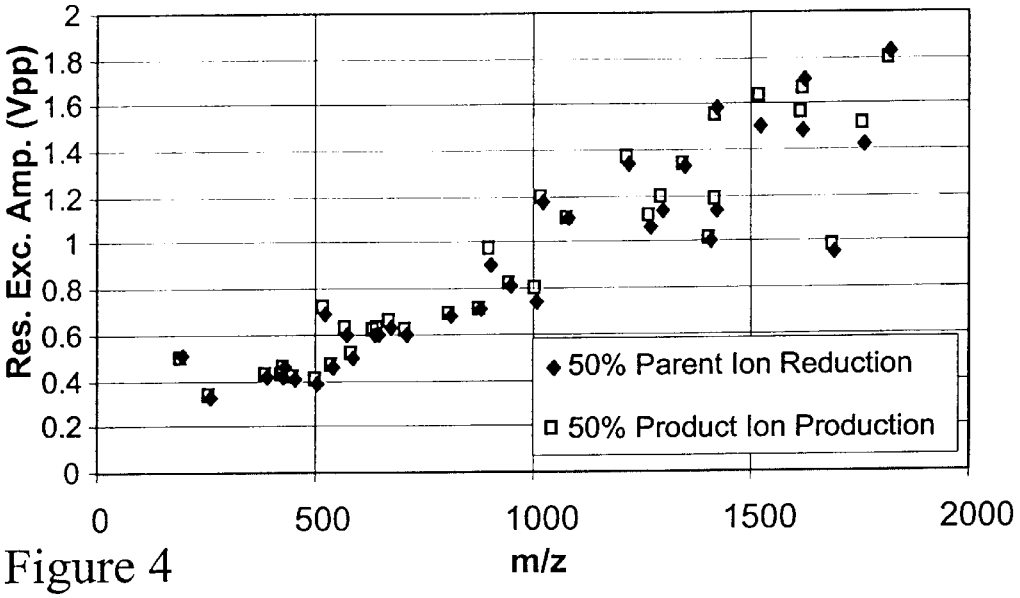
FIG. 4 is a plot of experimental data showing the correlation between the applied resonance excitation voltage amplitude to produce 50% product ion intensity and 50% parent ion reduction as a function of m/z for various ions including those with differing charge states.
Figure 5:
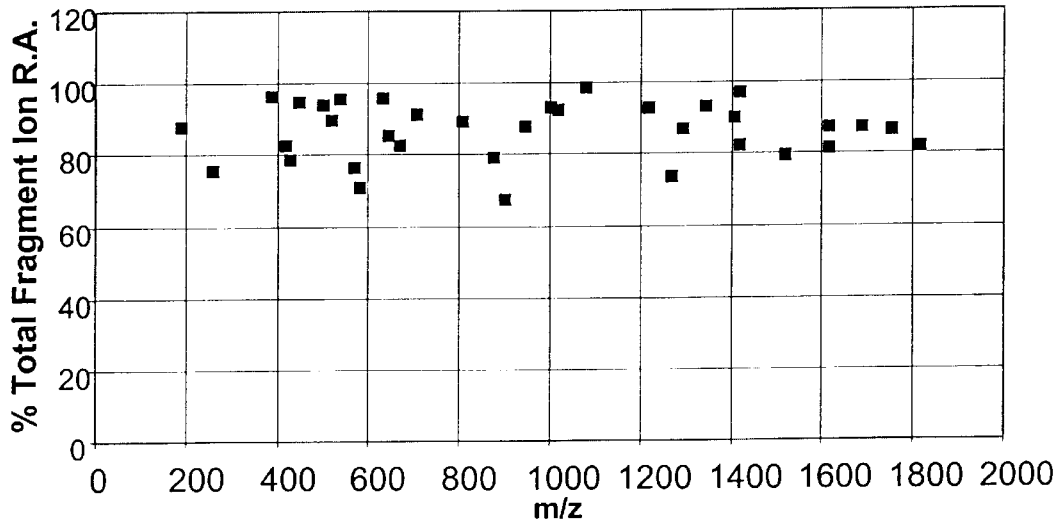
FIG. 5 is a plot of experimental data showing that when the resonance excitation amplitude is such that the parent ion intensity is reduced by 90%, then the average product ion intensity is 86% for all m/z ions including those with differing charge states.

Measuring parent ion reduction offers a faster and less complicated process than measuring total product ion intensity. As the four examples shown in FIGS. 2*a*–2*d* indicate, as well as the comparison of resonance excitation amplitude for parent ion reduction and production of product ions for all ions in Table 1 shown in FIG. 4, 50% reduction in parent ion intensity correlates well to a 50% increase in product ion intensity. In addition, FIG. 5 indicates that a 90% reduction of the parent ion intensity produces an average of nearly 90% (86%) total product ion intensity for all ions of Table 1.

Figure 6:
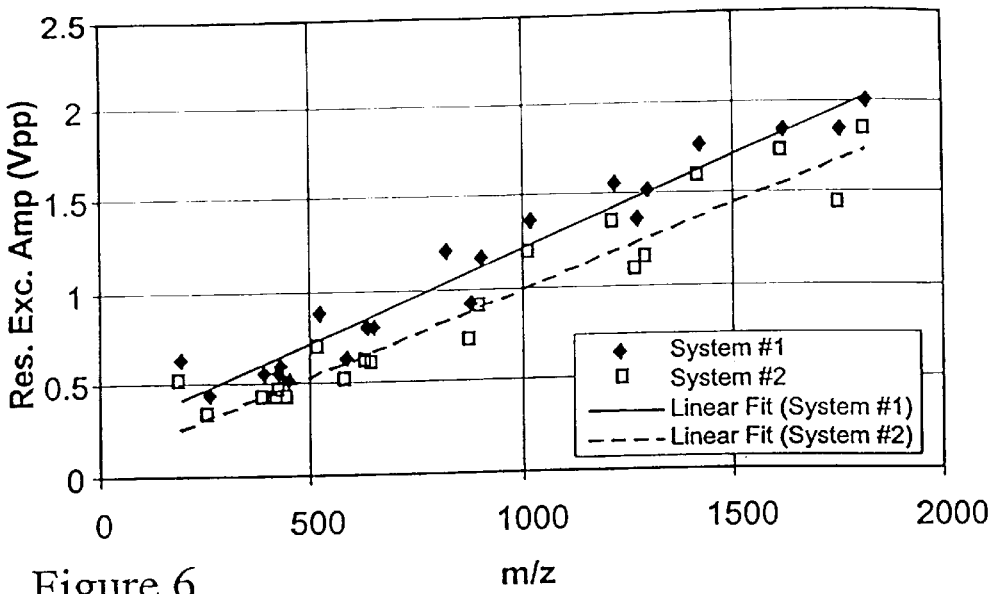
FIG. 6 illustrates that the required resonance excitation amplitude has a different linear relationship on two different instruments.

The exact linear relationship between optimum resonance excitation and m/z can vary from instrument to instrument due to differences in operating conditions such as Helium and background gas pressures, variations in electronics and mechanical tolerances. This is demonstrated in FIG. 6 which shows, for the same ions, the comparison of two different instruments which indicates significantly different linear fits of the resonance excitation amplitude required for 50% parent ion reduction.

By using the basic approach of measuring the resonance excitation required to reduce the parent ion intensity of just two calibrant ions by 90%, a linear calibration for any particular instrument can be quickly obtained. These values are then stored in the calibration file of the computer specific to that instrument. The two-point calibration is sufficient to characterize the relationship of optimum excitation voltage amplitude to the mass-to-charge ratio of an ion and can be used to normalize out differences in instrumental performance. A one-point calibration may be used if an intercept for the line is fixed at a certain value or a value of zero.

Figure 7:
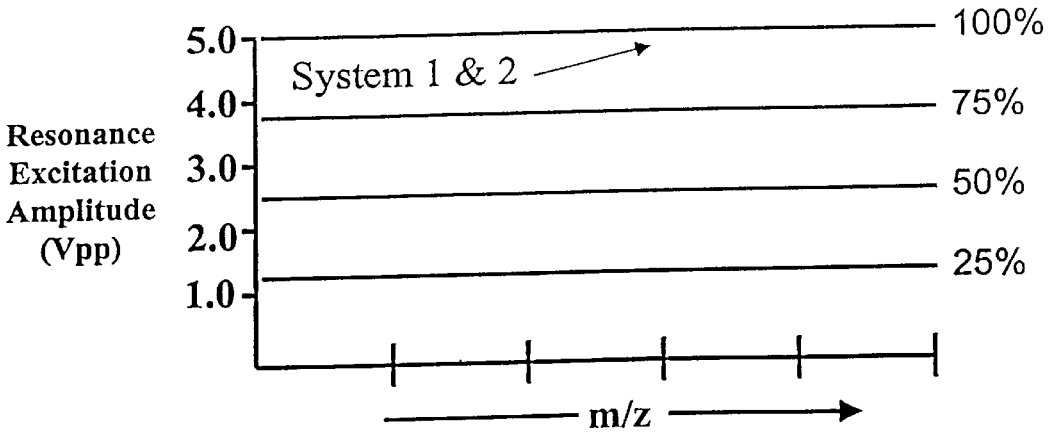
FIG. 7 illustrates the functional operation of the amplitude of the excitation voltage in accordance with the prior art.
Figure 8:
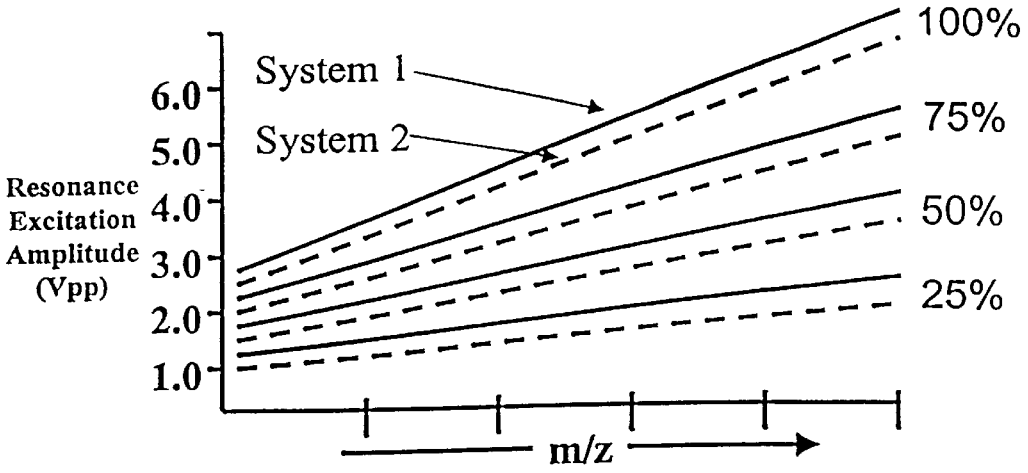
FIG. 8 illustrates the functional operation of the amplitude of the excitation voltage in accordance with the present invention.

As discussed above, for various experiments including those involving chromatography, often the ions which are produced are unknown and there is not time enough to optimize the excitation voltage amplitude for each ion. Using the prior art, a single value of the excitation voltage amplitude had to be chosen for all m/z values, and was done in units of relative collision energy (RCE), where 0 to 100% relative collision energy corresponds to 0 to 5 volts of resonance excitation amplitude. FIG. 7 shows the fixed amplitude scheme. FIG. 8 is the normalized collision energy scheme and contrasts the present invention to that of FIG. 7. In FIG. 8 the excitation voltage utilizes the calibration values and is linearly related to the m/z values. The actual excitation voltage amplitude at any given m/z can still be varied by changing the relative collision energy from 0 to 100%, however, the change of the actual excitation voltage is also m/z dependent. Also indicated in FIG. 8 is that the exact voltages corresponding to the same requested relative collision energy may vary from instrument to instrument, but that the experimental results will be substantially the same.

Figure 9:
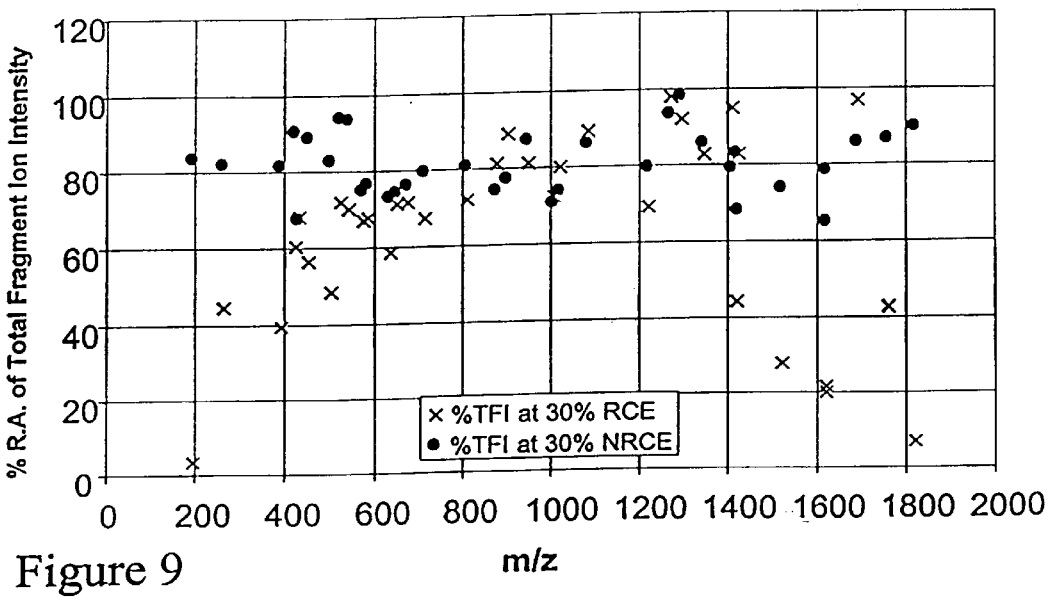
FIG. 9 illustrates the effectiveness of the present invention versus the prior art at producing a more consistent product ion intensity at one setting of the relative collision energy (RCE) for ions of various m/z (and charge state).

FIG. 9 compares the total product ion relative abundance produced using a fixed excitation amplitude to that achieved using a normalized one for the ions of Table 1. FIG. 9 clearly indicates the effectiveness of a normalized collision energy scheme as compared to using a fixed excitation amplitude. The relative collision energy (RCE) in both cases was chosen to be 30%. The data indicates that the fixed voltage method has poor performance for the lower and higher m/z ions and only has good performance for the intermediate m/z ions. While, in contrast, it is observed that using normalized collision energy yields a minimum of 65% of the total product ion abundance for all ions studied, with an average value of 80%. FIGS. 10A1–10D2 show examples of mass spectra corresponding to data of FIG. 9 for Caffeine $(M+H)^+$ (m/z 195.1), Met-Arg-Phe-Ala $(M+2H)^{2+}$(m/z 262.6), Renin Substrate $(M+2H)^{2+}$(m/z 880.0) and Renin Substrate $(M+H)^+$(m/z 1758.9), respectively, comparing fixed amplitude excitation RCE 30% and normalized amplitude excitation RCE=30%. At low m/z values such as 195.1 and 262.6 shown in FIGS. 10A1, 10A2 and 10B1, 10B2, respectively, too much amplitude is present using the fixed amplitude scheme which can eliminate, FIG. 10A1, or reduce, FIG. 10B1, the product ion abundance compared to the normalized method, At high m/z such as m/z 1758.9, FIGS. 10D1, 10D2, the fixed excitation voltage does not induce sufficient fragmentation and therefore reduces the information contained in the spectrum compared to the normalized collision energy scheme. At medium m/z such as 880.0, FIGS. 10C1, 10C2, the fragmentation is similar for both methods.

Thus, a method of ion excitation of ions in a quadrupole ion trap called normalized collision energy has been disclosed which improves the performance of the quadrupole ion trap by calibrating and automatically compensating the amplitude of the excitation voltage to be substantially linearly related to m/z. The result of this normalization process is to minimize the necessity to tune the resonance excitation amplitude for each individual ion and on each individual instrument which significantly improves the performance of automated and data dependent ion activation (MS/MS and $MS^n$) and its reproducibility,

TABLE 1

| Compound Name | Ion m/z | Charge State |
|---|---|---|
| Caffeine | 195.1 | 1 |
| Val—Gly—Ser—Glu | 391.2 | 1 |
| Met—Arg—Phe—Ala | 524.3 | 1 |
| Met-Enkephalin | 574.2 | 1 |
| des[Arg]-Bradykinin | 904.5 | 1 |
| Oxytocin | 1007.4 | 1 |
| UltraMark 1622 (1022) | 1021.99 | 1 |
| ($Arg^8$) Vasopressin | 1084.4 | 1 |
| UltraMark 1622 (1222) | 1221.99 | 1 |
| APG ($Ile^5Val^3$) Angiotensin II | 1271.6 | 1 |
| Angiotensin I | 1296.7 | 1 |
| Substance P | 1347.7 | 1 |
| UltraMark 1622 (1422) | 1421.97 | 1 |
| UltraMark 1622 (1522) | 1521.96 | 1 |
| Bombesin | 1619.8 | 1 |
| UltraMark 1622 (1622) | 1621.95 | 1 |
| Renin Substrate | 1758.9 | 1 |
| UltraMark 1622 (1822) | 1821.96 | 1 |
| Met—Arg—Phe—Ala | 262.6 | 2 |
| des[Arg]-Bradykinin | 452.7 | 2 |
| Oxytocin | 504.2 | 2 |
| ($Arg^8$) Vasopressin | 542.7 | 2 |
| APG ($Ile^5Val^3$) Angiotensin II | 636.4 | 2 |
| Angiotensin I | 648.8 | 2 |
| Substance P | 674.4 | 2 |
| Bombesin | 810.4 | 2 |

TABLE 1-continued

| Compound Name | Ion m/z | Charge State |
|---|---|---|
| Renin Substrate | 880.0 | 2 |
| Melittin | 1424.3 | 2 |
| APG ($Ile^5Val^3$) Angiotensin II | 424.6 | 3 |
| Angiotensin I | 432.9 | 3 |
| Renin Substrate | 587.3 | 3 |
| Melittin | 949.8 | 3 |
| Melittin | 712.6 | 4 |
| Ubiquitin | 1693.0 | 5 |
| Ubiquitin | 1409.2 | 6 |

What is claimed is:

1. A method of generating product ions in a quadrupole ion trap which comprises the steps of trapping ions having a mass-to-charge (m/z) ratio of interest in said trap, exciting said ions by applying an excitation voltage selected to have an amplitude which is substantially linearly related to the mass-to-charge ratio (m/z) of the selected ions to cause the selected ions to become kinetically excited and to collisionally dissociate.

2. The method of generating product ions as in claim 1 in which ions are excited at or near resonance.

3. The method of generating product ions as in claim 1 in which ions are excited at resonance.

4. A method as in claims 1, 2 or 3, where the substantially linear relationship is calibrated for each instrument by determining the amplitude of the excitation voltage for ions of at least one mass-to-charge ratio (m/zs) for the instrument.

5. The method as in claims 1, 2 or 3, where the substantially linear relationship is calibrated for each instrument by determining the amplitude of the excitation voltages for ions of at least two mass-to-charge ratios for the instrument.

6. A method as in claim 4, where the linear relationship is calibrated for each instrument by determining the excitation amplitude required to reduce the parent ion intensity by a fixed percentage for each mass-to-charge ratio.

7. A method as in claim 5, where the linear relationship is calibrated for each instrument by determining the excitation amplitude required to reduce the parent ion intensity by a fixed percentage for each mass-to-charge ratio.

8. The method as in claim 4 where the linear relationship is calibrated for each instrument by determining the excitation amplitude required to produce a product ion intensity of a fixed percentage for each mass-to-charge ratio.

9. The method as in claim 5 where the linear relationship is calibrated for each instrument by determining the excitation amplitude required to produce a product ion intensity of a fixed percentage for each mass-to-charge ratio.

10. The method of mass analyzing product ions of parent ions in a quadrupole ion trap which comprises the steps of trapping the parent ions of more than one mass-to-charge ratio, exciting ions of said more than one mass-to-charge ratio by applying an excitation voltage selected to have an amplitude which is substantially linearly related to the mass-to-charge ratios (m/zs) of said ions to cause the excited ions to undergo collisional dissociation, to form product ions.

11. The method of generating product ions as in claim 10 in which the ions are excited at or near resonance.

12. The method of generating product ions as in claim 10 in which the ions are excited at resonance.

13. A method as in claims 10, 11 or 12, where the substantially linear relationship is calibrated for each instrument by determining the amplitude of the excitation voltage for ions of at least one mass-to-charge ratio (m/zs) for the instrument.

14. The method as in claims 10, 11 or 12, where the substantially linear relationship is calibrated for each instrument by determining the amplitude of the excitation voltages for ions of at least two mass-to-charge ratios for the instrument.

15. A method as in claim 13, where the linear relationship is calibrated for each instrument by determining the excitation amplitude required to reduce the parent ion intensity by a fixed percentage for each mass-to-charge ratio.

16. A method as in claim 14, where the linear relationship is calibrated for each instrument by determining the excitation amplitude required to reduce the parent ion intensity by a fixed percentage for each mass-to-charge ratio.

17. The method as in claim 13 where the linear relationship is calibrated for each instrument by measuring the excitation amplitude required to produce a product ion intensity of a fixed percentage for each mass-to-charge ratio.

18. The method as in claim 14 where the linear relationship is calibrated for each instrument by measuring the excitation amplitude required to produce a product ion intensity of a fixed percentage for each mass-to-charge ratio.

19. A method of generating product ions in a quadrupole ion trap which comprises the steps of:

introducing a collision gas into said ion trap, trapping ions having a mass-to-charge (m/z) ratio of interest in said trap, and exciting said ions by applying an excitation voltage selected to have an amplitude which is substantially linearly related to the mass-to-charge ratio (m/z) of the selected ions to cause the selected ions to become kinetically excited and to collisionally dissociate.

20. The method of generating product ions as in claim 19 in which the ions are excited at or near resonance.

21. The method of generating product ions as in claim 19 in which the ions are excited at resonance.

22. A method as in claims 19, 20 or 21, where the substantially linear relationship is calibrated for each instrument by determining the amplitude of the excitation voltage for ions of at least one mass-to-charge ratio (m/zs) for the instrument.

23. The method as in claims 19, 20 or 21, where the substantially linear relationship is calibrated for each instrument by determining the amplitude of the excitation voltages for ions of at least two mass-to-charge ratios for the instrument.

24. A method as in claim 23, where the linear relationship is calibrated for each instrument by measuring the excitation amplitude required to reduce the parent ion intensity by a fixed percentage for each mass-to-charge ratio.

25. The method as in claim 23 where the linear relationship is calibrated for each instrument by measuring the excitation amplitude required to produce a product ion intensity of a fixed percentage for each mass-to-charge ratio.

26. A method as in claim 22, where the linear relationship is calibrated for each instrument by measuring the excitation amplitude required to reduce the parent ion intensity by a fixed percentage for each mass-to-charge ratio.

27. The method as in claim 22 where the linear relationship is calibrated for each instrument by measuring the excitation amplitude required to produce a product ion intensity of a fixed percentage for each mass-to-charge ratio.

* * * * *

UNITED STATES PATENT AND TRADEMARK OFFICE

CERTIFICATE OF CORRECTION

PATENT NO. : 6,124,591
DATED : September 26, 2000
INVENTOR(S) : Schwartz et al.

It is certified that error appears in the above-identified patent and that said Letters Patent is hereby corrected as shown below:

Column 5,
Line 13, delete "10D2" and replace with -- 10C4 --;
Lines 24-25, delete "10D1, 10D2" and replace with -- 10C3, 10C4 --.

Signed and Sealed this

Second Day of October, 2001

*Attest:*

Nicholas P. Godici

NICHOLAS P. GODICI
*Acting Director of the United States Patent and Trademark Office*

*Attesting Officer*